United States Patent [19]

Fender

[11] Patent Number: 5,016,685

[45] Date of Patent: May 21, 1991

[54] DEVICE FOR SLIDING AND FLOATING A BOAT LIFT

[76] Inventor: Norman N. Fender, 520 Shady La., Posey Lake, Hudson, Mich. 49247

[21] Appl. No.: 327,905

[22] Filed: Mar. 23, 1989

[51] Int. Cl.[5] ..... B63C 1/02

[52] U.S. Cl. ..... 114/45; 114/345; 114/263

[58] Field of Search ..... 114/44–52, 114/123, 345, 263; 405/3, 4, 219; 441/131

[56] References Cited

U.S. PATENT DOCUMENTS

| | | | |
|---|---|---|---|
| 2,151,394 | 3/1939 | Rogers | 61/65 |
| 3,268,208 | 8/1966 | Feilbach et al. | 254/2 |
| 3,284,052 | 11/1966 | Godbersen | 405/3 |
| 3,537,412 | 11/1970 | Henderson | 114/0.5 |
| 3,648,314 | 3/1972 | Garrison | 114/53 |
| 4,018,179 | 4/1977 | Rutter | 114/45 |
| 4,072,119 | 2/1978 | Williams | 114/45 |
| 4,280,429 | 7/1981 | Wells | 114/45 |

FOREIGN PATENT DOCUMENTS

| | | | |
|---|---|---|---|
| 2528005 | 12/1983 | France | 114/45 |

*Primary Examiner*—Ed Swinehart
*Attorney, Agent, or Firm*—Paul L. Sjoquist

[57] ABSTRACT

The present invention is a device for attachment to the leg of a boat lift, wherein the device has a housing with a lower surface of substantial area and an air entrapment volume therein; the air entrapment volume is coupled via a connectable air step to an air hose which connects to an air valve. A source of pressurized air is coupled to the air valve.

4 Claims, 2 Drawing Sheets

Fig. 1
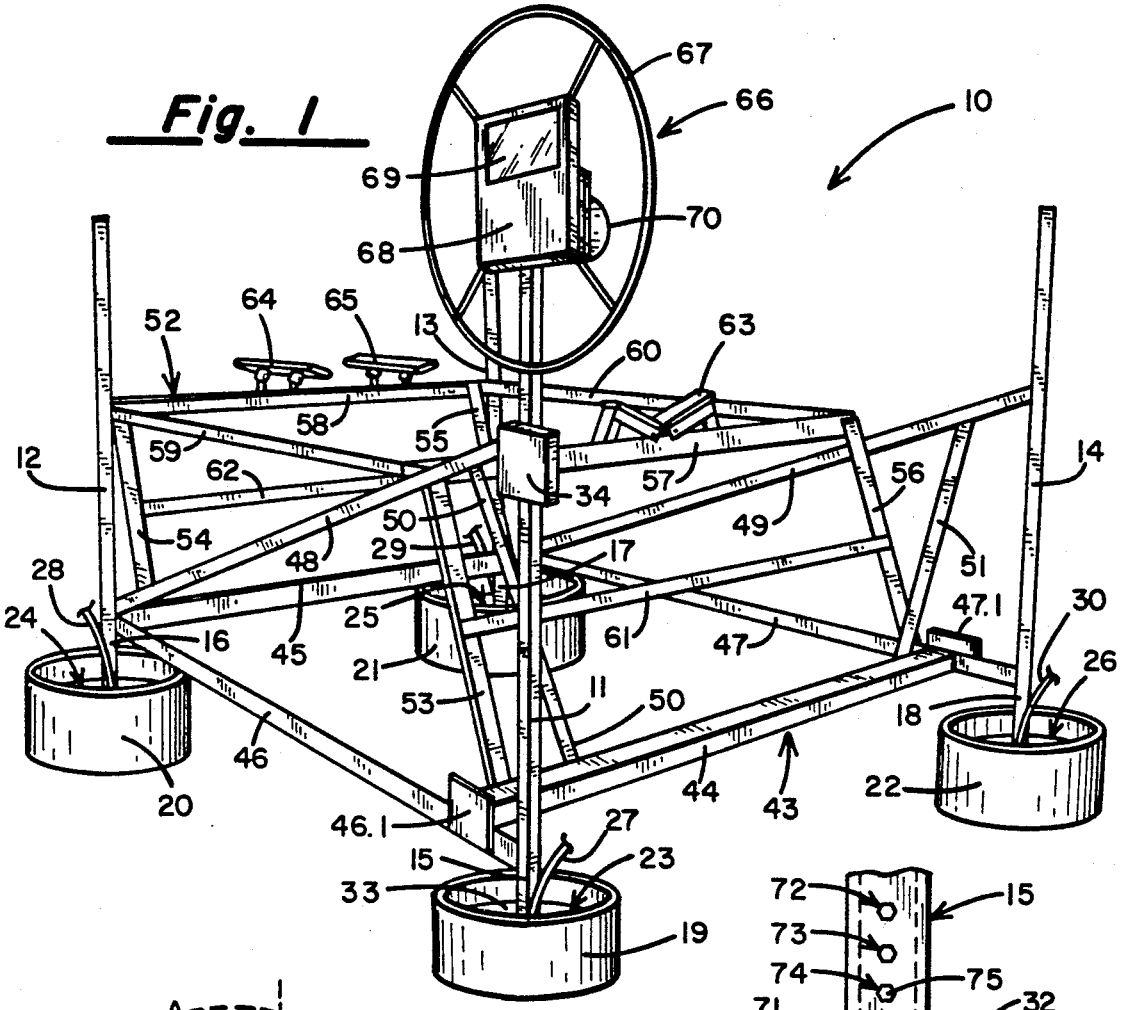
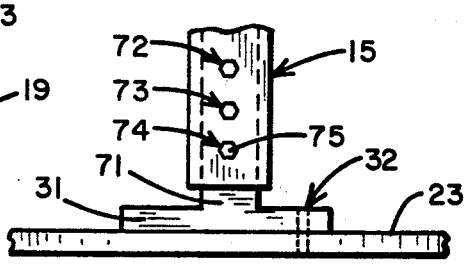
Fig. 4
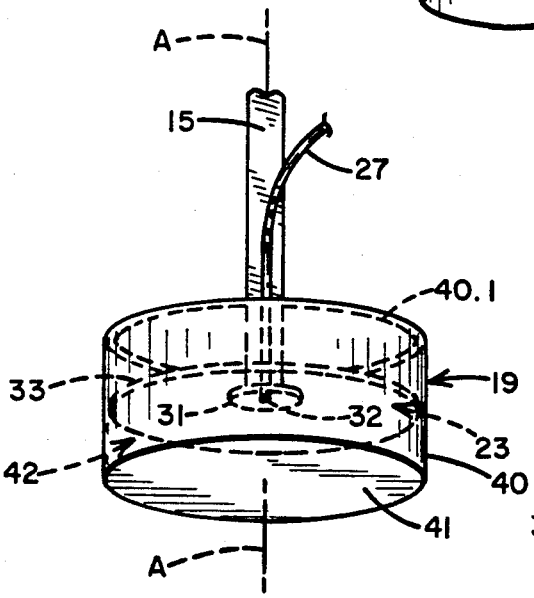
Fig. 2
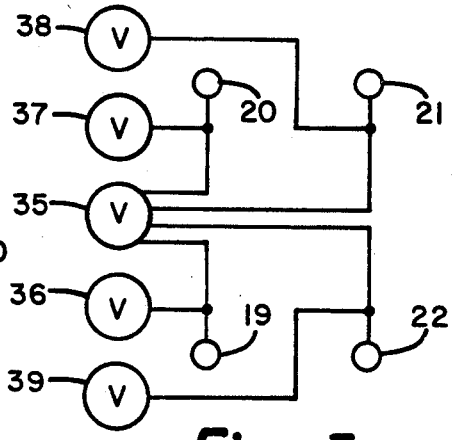
Fig. 3

DEVICE FOR SLIDING AND FLOATING A BOAT LIFT

BACKGROUND OF THE INVENTION

The present invention relates to docks and boat lifts and more particularly to floatable and pneumatically operable docks and boat lifts.

It is the practice, particularly in inland lakes in northern climates, to erect or install boat docks and boat lifts into the lake during the early spring, and to remove these items at the end of the summer and before lake freeze-up. In the case of some boat docks, it is necessary to wholly or partially dismantle the dock at the time it is removed from the lake, and to reassemble the dock during the spring when it is replaced into the lake. It has become a common practice to construct docks in sections, so that assembly and disassembly can be accomplished by one or two people with a minimum of inconvenience. Boat lifts, on the other hand, are typically constructed from a network of frame members which is made as lightweight as practical, so as to facilitate easy removal and replacement of the entire framework. The framework may be constructed so as to have skids on the bottom of its legs, to thereby make the task of removal and replacement easier.

It would be an advantage if such devices could be constructed so as to be conveniently moved in and out of position relative to the water, and more particularly, it would be an advantage if such devices could be merely floated into position and thereafter sunk into the lake bed; upon removal from the lake it would be an advantage if such devices could be refloated for purposes of removal. The prior art exemplifies a number of attempts which have been made to accommodate this problem, as illustrated in the following paragraphs.

The Rogers U.S. Pat. No. 2,151,394, issued Mar. 21, 1939 and entitled "Boat's Drydock," discloses a fluid-operated raising and lowering plunger vertically disposed within a fluid cylinder countersunk in a bed. Pipes deliver and discharge fluid under pressure to and from the cylinder for operation of the plunger. A cradle is fixed to the upper end of the plunger to accommodate a ship.

The Henderson U.S. Pat. No. 3,537,412, issued Nov. 3, 1970 and entitled "Stabilizer for Marine Vessels," discloses a set of buoy pipes to be secured on each side and each end of a vessel. The pipes project downwardly into water beyond the draft of the vessel. The lower end of the pipes are open while the upper end is closed. Air is pumped into the buoy pipes to displace water therefrom. The air pressure within the pipes generates an upward force to pneumatically jack the vessel above the water's surface.

The Garrison U.S. Pat. No. 3,648,314, issued Mar. 14, 1972, entitled "Self-Stabilizing Flotation Module," discloses a module having open-bottomed containers from which liquid is displaced by gas for lifting submerged material. In operation, the module may be placed in the water and submerged by venting entrapped gas. At the desired location, it may be attached to an object, and the water within the containers displaced by gas.

The Rutter U.S. Pat. No. 4,018,179, issued Apr. 19, 1977, and entitled "Pontoon System for Supporting Watercraft on a Body of Water," discloses a submersible structure comprised of pontoons into which air is injected, expelling the water therefrom to provide lift for lighter and heavier portions of the structure. The structure includes support pads which contact the hull and keel of a water craft. Air may be released from the pontoons for lowering the structure into the water.

The Wells U.S. Pat. No. 4,280,429, issued July 28, 1981, and entitled "Floating Boat Storage Dry Dock," discloses a tubular, boat-supporting platform made from a planar array of interconnected conduit and a pair of vertical, buoyant, tubular sidewalls connected to the platform. Water is pumped into and out of the platform tubular array to control the depth level of the platform. The vertical sidewall conduits are filled with air to add positive buoyancy to the platform.

Boat lifts for runabouts, fishing boats, sailboats, and the like are widely commercially available in many sizes and configurations. Such boat lifts usually have a cabling system, a self-braking winch, adjustable leveling legs, and rear cradles that adjust vertically and horizontally to support a boat.

Commercially available boat lifts are allegedly portable, but they frequently weigh from 300 to 1,000 pounds and have beam widths ranging from five to ten feet. Moreover, although they may be "portable" by being arguably attachable to a trailer, the lifts themselves have no transportation means such as wheels. Even if a lift of the type available is transported on a trailer which is driven into a lake, depositing of the lift typically requires at least a four-man operation, especially for a massive boat lift. Situating the lift also requires wading into the water, and a diving operation to adjust the height of the boat lift. Such efforts must be expended for each change of location of the boat lift.

SUMMARY OF THE INVENTION

An object of the present invention is to provide a floatable and thereby portable dock or boat lift.

Another object of the present invention is to provide a pneumatically operable dock or boat lift.

A feature of the present invention is a device attachable to each of four structural legs. The bottom end of each leg is connected to and supported by a platform connected to and vertically movable by a flotation member. The legs may be adjustable by telescoping members connected therein.

An air hose supplies and bleeds pressurized air to and from the interior of the flotation member. When pressurized air is supplied to the flotation member, the air pressure supplies an upward force to raise the respective structural leg. When air is bled from the flotation member, the air volume in the flotation member decreases and the structural leg is lowered. The air pressure in the flotation members may be independently or jointly controlled.

In the following specification, particular reference to the invention is made in conjunction with its application as a portable boat lift. However, it should be apparent that the principles described herein are equally applicable to use of the invention in conjunction with a portable docking mechanism, or other device desirably intended for placing and removing from the water with ease.

In operation, the flotation members are supplied with pressurized air so that the boat lift is buoyant when placed in the water. This step may be performed regardless of whether the boat lift is on land, in water, or affixed to a trailer.

The boat lift may be transported to the desired operating marine location which may be adjacent a boat dock. Since it is buoyant, the boat lift is readily and floatably transported to the prescribed site.

After the boat lift has been transported to a suitable location, air pressure in the flotation members is relieved. The boat lift thus submerges and settles to the lake or river bottom. The boat lift remains at its immersed location for the period of use desired. When its location is to be changed or the boat lift is to be removed from the water, air is supplied to the flotation members and the process is reversed.

A feature of the invention is that the flotation member is associated with a housing having a bottom surface of substantial cross-sectional area, compared with the cross-sectional area of a boat lift leg, so that the housing may be easily slidable over the ground and into the water.

An advantage of the present invention is to provide a dock or boat lift that is readily transportable. By virtue of its buoyancy, the device is easily moved on or close to the surface of the water. Since it is submersible, it is easily deposited on a lake or river bottom. Thus, a boat lift is conveniently moved to and from a lake at the opening and closing of a boating season. Moreover, the location of the boat lift may be changed during the boating season if, for instance, the water level of the lake or river changes.

Still another advantage of the present invention is that air may be supplied to and bled from the flotation members simultaneously as well as independently, thus allowing maintaining a level attitude while immersing. Accordingly, the boat lift is quickly floatable and immersible.

Still another advantage of the present invention is that the boat lift's structural legs may be both mechanically and pneumatically adjusted for maintaining the boat lift in a leveled orientation for a long or short period of time. It is usually preferable to utilize a telescoping member in each leg to level the boat lift so that each leg may rest on the bottom.

Still another advantage of the present invention is that the amount of mechanical adjustment needed to level the boat lift may be readily determined by first pneumatically adjusting the boat lift. The amount of air supplied to each flotation member may be correlated to the amount of adjustment needed for each respective structural leg.

BRIEF DESCRIPTION OF THE DRAWINGS

FIG. 1 is a perspective view of a portable boat lift with one embodiment of the invention attached thereto;

FIG. 2 is a perspective view of a drum of the flotation member of FIG. 1 and shows in phantom a piston connected in a drum to a leg of the boat lift;

FIG. 3 is a schematic illustration of the pneumatic features of the invention;

FIG. 4 shows a partial view of one form of leg of the boat lift shown in FIG. 1;

DETAILED DESCRIPTION OF THE PREFERRED EMBODIMENT

Figure 5:
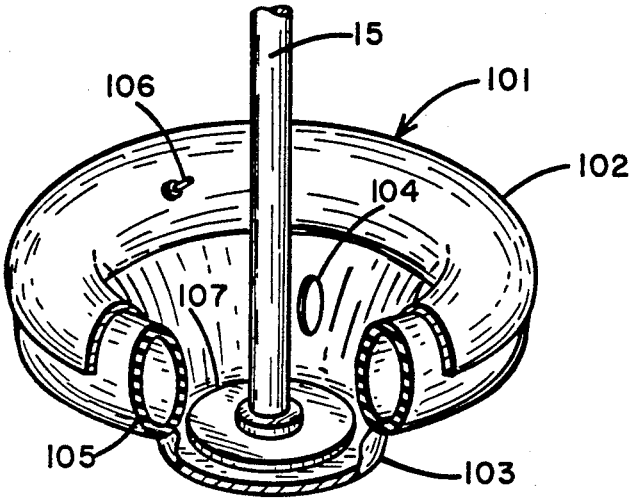
FIG. 5 shows an isometric view of another form of the invention.

As shown in FIG. 1, a portable and floatable boat lift 10 has a set of four vertical structural legs 11–14. Each leg 11-14 has a respective bottom leg extension 15–18.

Each bottom extension 15–18 is connected to a piston 23-26 in a respective drum 19–22, and each piston is respectively pneumatically and vertically movable.

A set of air hoses 27–30 extend from respective drums 19–22. As shown in FIG. 2, piston 23 includes a support plate 31 having an aperture 32 for connection to the air hose 27. Support plate 31 is connected to leg extension 15 and a top face 33 of piston 23. Leg extension 15, drum 19, piston 23, and support plate 31 share a common vertical axis A. Drums 20–22 and pistons 24–26 include the same features as drum 19 and piston 23.

As shown in FIG. 2, drum 19 has a circular wall 40 having an inwardly protruding lip 40.1 and a bottom end 41. Wall 40, end 41, and piston 23 create a spatial drum interior 42. The sizes of the drums 19–22 and the volume of drum interior 42 for buoyancy may be determined by the mass of the boat lift 10.

As shown in FIGS. 1 and 3, a control box 34 connected to leg 11 for controlling the flow of air through air hoses 27–30 to the interiors of the drums 19–22 may have a set of five valves 35–39. Air may be supplied to or bled from drums 19–22 simultaneously by operating main valve 35 or independently by utilizing respective independent valves 36–39.

As air is supplied to drum 19 through air hose 27 by either valve 35 or 36, air pressure in the interior 42 is increased. When the air pressure is increased sufficiently, piston 23 moves vertically by the air pressure creating an upward force. The piston 23 is prevented from vertically escaping from drum 19 by drum lip 40.1. When air is bled from interior 42 by either valve 35 or 36, air pressure is decreased and piston 23 moves downwardly. Piston 23 may rest on bottom end 41 of drum 19. Drums 20–22 operate in a similar manner to drum 19 and piston 23.

As shown in FIG. 1, a main frame 43 is connected to and includes the structural legs 11–14. The frame 43 has a pair of transverse arms 44–45, a pair of longitudinal and horizontal arms 46–47, and a pair of longitudinal and oblique arms 48–49. Horizontal arms 46–47 are connected at their opposing ends to lower portions of legs 11–12 and legs 13–14 respectively. Each end of transverse arm 45 is connected to a first end of each horizontal arm 46–47. Horizontal arms 46–47 are connected near their opposite and second ends to the ends of transverse arm 44. Transverse arm 44 is connected to horizontal arms 46–47 inwardly of structural legs 11 and 14. Oblique arms 48–49 are connected at their ends to respective lower portions of legs 12–13 and respective upper portions of legs 11 and 14. Frame 43 further includes a pair of support arms 50–51. The ends of arms 50–51 are connected to the ends of transverse arm 44 and the corresponding upper ends of oblique arms 48–49. Longitudinal arms 46–47 include a pair of respective support plates 46.1–47.1 to reinforce the connection to transverse arm 44.

A winch frame or hoisting structure 52 is pivotably and slidably connected to the main frame 43. The winch frame 52 has a set of four winch legs 53–56 connected at their top ends to the ends of a pair of transverse winch arms 57–58 and the ends of a pair of longitudinal winch arms 59–60. The lower ends of the winch legs 53 and 56 are pivotably connected to opposing ends of transverse arm 44. The lower ends of the winch legs 54–55 are pivotably connected to opposing ends of transverse arm 45. A further pair of transverse winch arms 61–62 are connected at their ends to middle portions of winch legs 53 and 56 and winch legs 54–55, respectively. Transverse winch arm 57 is slidably connected to oblique arms 48 and 49. A front cradle 63 and a pair of rear cradles 64–65 are connected to respective transverse winch arms 57–58 for supporting the bottom or keel of a boat.

A winch 66 is connected to an upper portion of structural leg 11. The winch 66 includes a wheel 67, a control box 68 having a control panel 69, and a pulley 70. The winch 66 further includes a block and tackle (not shown) for operating the winch frame 52. The winch 66 may be either hand-driven or motor-driven to hoist or lower a boat resting on a winch frame 52. The block and tackle includes cables (not shown) operatively connected between the pulley 70 and the frames 43 and 52.

As shown in FIG. 4, a telescoping support member 71 may be integrally connected to the support plate 31 and slidably connected in leg extension 15. Member 71 and extension 15 may each include a plurality of cooperating apertures 72–74. Leg extension 15 is adjustable in length by a removably connectable bolt 75. Member 71, apertures 72–74, and bolt 75 are provided for each leg extension 15–18. Telescoping member 71 and leg extensions 15–18 may include additional apertures for greater adjustment.

The specific boat lift construction illustrated in FIG. 1 is by way of example only; other forms of boat lifts, and other forms of docks may be readily usable in connection with the present invention. The invention principally contemplates a plurality of supporting legs, usually four, downwardly projecting from the boat lift and each leg having a foot pad for supporting the leg on the bottom of the lake or river. In its broadest construction, the invention contemplates a further support plate which is attachable to the foot pad of each of the plurality of support legs, and a flotation member connected to the further support plate for accomplishing the results described herein.

FIG. 5 shows an isometric view of another form of the invention. Housing 101 is preferably formed of a single piece of material, by a molding or similar process, to contain the essential elements of the invention. Housing 101 includes an enlarged circular upper portion 102 and a lower projecting portion 103. Upper portion 102 is at least partially curved in the form of a ring or doughnut, and is joined via an inner recess to lower portion !03. One or more openings 104 are provided to permit water to flow into and out of the interior of lower portion 103. Upper portion 102 is sized to accept an inner tube 105, or other similar flotation member, and may have an interior aperture to provide an opening for projecting a valve stem 106 from the inner tube to the interior recess of the device. A support plate 107 is connectable to a boat lift leg 15, and is sized to be contained within the inner recess formed by the lower portion 103. It has been found to be important to form the outside surface of lower portion 103 in a rounded or curved fashion, so as to improve the ability of the device to slide over the ground.

Figure 6:
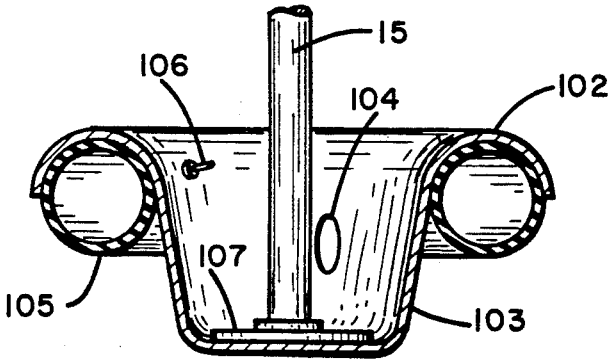
FIG. 6 shows a cross-sectional view of the form illustrated in FIG. 5.

FIG. 6 shows a cross-sectional view of the embodiment shown in FIG. 5. Support plate 107 is affixed to the interior recess surface of bottom portion 103, which is outwardly curved to facilitate sliding when necessary.

Figure 7:
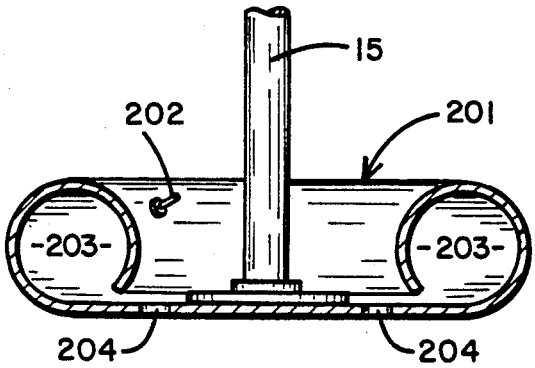
FIG. 7 shows a cross-sectional view of yet another form of the invention.

FIG. 7 shows yet another embodiment of the invention, wherein a housing 201 is entirely utilized as the flotation member. Housing 201 has a valve inlet 202 for accepting pressurized air, and the interior space 203 within housing 20; is designed to capture pressurized air when the device is submerged. By selectively filling the interior space 203 with pressurized air the device can be made more or less buoyant, and by selectively bleeding pressurized air from the valve 202 the device can be sunk to the bottom of a lake or river. A plurality of bottom openings 204 permit water to flow in and out of the housing 201.

Figure 8:
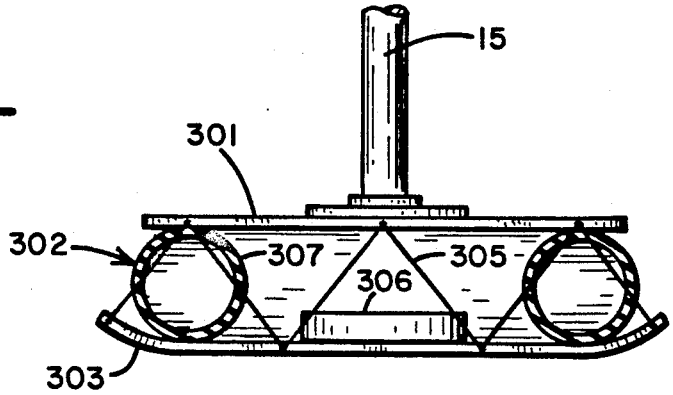
FIG. 8 shows a cross-sectional view of still another form of the invention.

FIG. 8 shows yet another embodiment of the present invention, wherein a flotation member 302 may comprise a standard inner tube. Flotation member 302 is contained between an upper platform 301 and a lower slidable platform 303. The boat lift leg 15 is secured to upper platform 301, and the upper platform 301 is secured to the lower sliding platform 303 by means of a web or rope connection 305. In this embodiment, an inner tube 307 may be selectively inflated to create buoyancy, and also to lift the upper platform 301 relative to the lower platform 303. When the boat lift is to be submerged into the water, air is released from the inner tube 307 to cause it to deflate and to thereby lower the upper platform 301 downwardly. A lower supporting block 306 is preferably used to provide a lower limit to the degree of compression to which the inner tube 307 will be subjected. It is preferable that the lower slidable member 303 have upwardly curved edges in order to facilitate the sliding action.

In operation, an air compressor (not shown) may be utilized to supply air pressure to the flotation member. The air is supplied by the control box 34, main valve 35 and air hoses 27–30. When a sufficient amount of air pressure has been created in the interiors of the flotation members, the boat lift 10 will become buoyant. When the boat lift 10 becomes buoyant, which may depend on the mass of the boat lift 10 and the size of and the volume of air in the flotation members, the lift 10 is transportable to its desired location of use. The lift 10 is floatable on or near the surface of the water.

After the lift 10 has been transported to its operating marine site, air is bled jointly from the flotation members. When a sufficient amount of air has been bled from the flotation members, the boat lift 10 submerges and sinks to settle on the lake or river bottom.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A support and buoyancy attachment for connecting to the support legs of boat lifts comprising a housing having means for attachment to one of said support legs, said housing having a dish-shaped bottom surface with an inner recess, said bottom surface having substantially greater area than the cross-sectional area of the support leg to which it is attachable; said housing further comprising an upper portion having a doughnut-shaped cavity; an air entrapment volume contained about said housing; a connectable air stem coupled to said air entrapment volume; and means for selectively introducing and bleeding pressurized air to said connectable air stem.

2. The apparatus of claim 1, wherein said connectable air stem is formed in the upper portion of said housing.

3. The apparatus of claim 1, wherein said air entrapment volume further comprises an inflatable inner tube contained within said doughnut-shaped cavity, said housing having an aperture therethrough to receive the air stem of said inner tube.

4. A floatable and pneumatically-operated support for docks and boat lifts which are supportable above the water surface by legs standing in the water, comprising:

(a) a plurality of air containers, one air container independently associated with each of said legs, each container having an air chamber comprising an inner tube attached about one of said legs;

(b) means for introducing air into each of said containers to increase the buoyancy thereof and to expand said air chamber;

(c) means for bleeding air from each said air chamber to reduce the buoyancy of each said container.

* * * * *